United States Patent [19]

Roccaforte

[11] 3,934,719

[45] Jan. 27, 1976

[54] DISPLAY CARTON FOR TUBES

[75] Inventor: Harry I. Roccaforte, Western Springs, Ill.

[73] Assignee: Hoerner Waldorf Corporation, St. Paul, Minn.

[22] Filed: Nov. 13, 1974

[21] Appl. No.: 523,216

[52] U.S. Cl. ..... 206/45.14; 206/45.19; 206/277

[51] Int. Cl.[2] ..... B65D 5/50

[58] Field of Search ..... 206/45.14, 45.19, 277

[56] References Cited

UNITED STATES PATENTS

| | | | |
|---|---|---|---|
| 2,946,433 | 7/1960 | Hennessey | 206/45.19 |
| 3,302,778 | 2/1967 | McGorty et al. | 206/45.14 |
| 3,419,133 | 12/1968 | Stone | 206/45.14 |
| 3,493,103 | 2/1970 | Cote | 206/45.14 |
| 3,584,740 | 6/1971 | Hanson | 206/45.14 |

*Primary Examiner*—Leonard Summer
*Attorney, Agent, or Firm*—Jerry F. Best

[57] ABSTRACT

A display carton for deformable dispensing tubes in which the tube is oriented with the cap down in an opening formed in the front of the carton, with an inwardly folded flap at the bottom thereof on which the tube cap rests. The crimped base of the tube is held in position between opposed sections of the front of the carton above the opening, the opposed sections formed by a line cut and separated to exert a shearing force on the crimped end of the tube. Also disclosed is a locking flap positioned to restrain the crimped end of the tube from moving inward by holding the tube in position in the carton.

3 Claims, 5 Drawing Figures

DISPLAY CARTON FOR TUBES

BACKGROUND OF THE INVENTION

1. Field of the Invention

This application relates generally to cartons with means for displaying the contents thereof and more particularly to display cartons adapted for containing and displaying deformable dispensing tubes.

2. Description of the Prior Art

It is undesirable in some instances to ship deformable plastic tubes loosely together in a large carton, and therefore most tubes are shipped in individual paperboard cartons. In those instances where it is desirable to display the tube it is necessary to either remove the tube from the carton and place it in a special stand or fabricate the carton with a window therein. Cartons with windows having transparent film overlays are expensive and do not allow the consumer to get a good view of the product.

SUMMARY OF THE INVENTION

A carton for use with deformable dispensing tubes which holds the tube in an opening cut in the side of the carton making a package appropriate for display purposes, wherein there is a support flap inwardly folded from the lower portion of an opening cut in the front panel of the carton and on which the dispensing tube is placed with a line cut at the opposite end into which the crimped end of the dispensing tube is inserted to hold it in position. A restraining flap engageable with the crimped end of the tube prevents the tube from moving out of position on the support flap.

DETAILED DESCRIPTION OF THE PREFERRED EMBODIMENT

Figure 1:
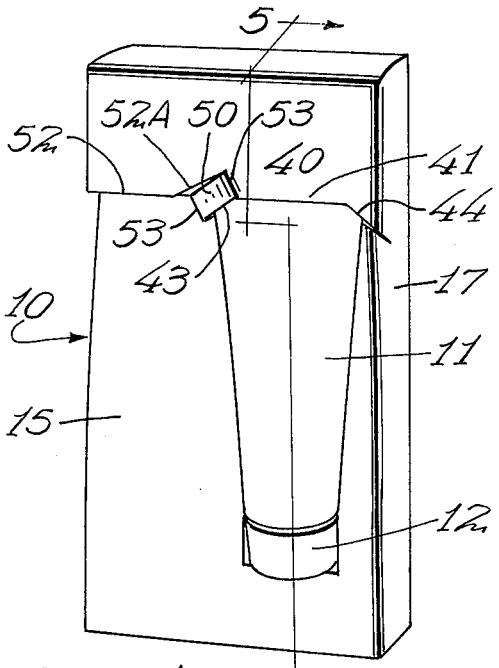
FIG. 1 is a perspective view of the front of a package embodying the present invention.
Figure 2:
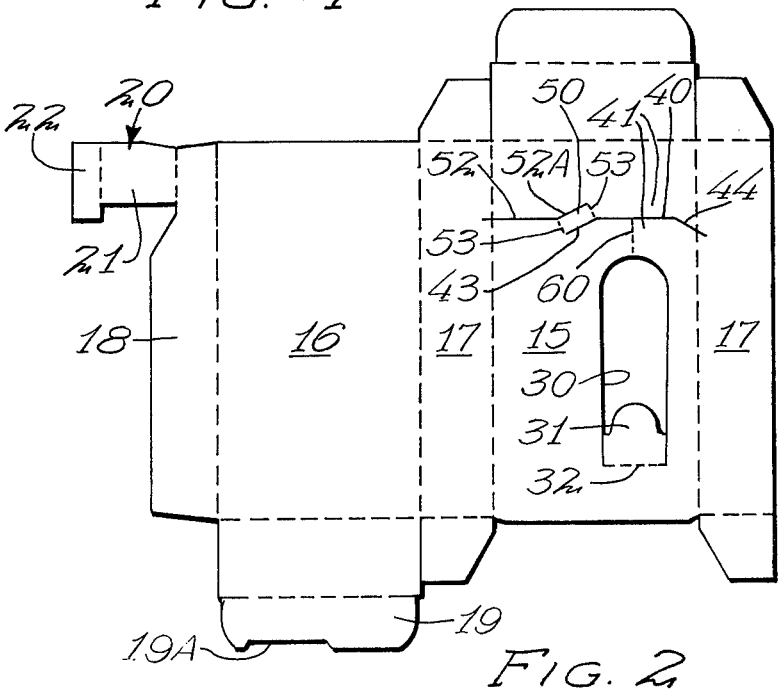
FIG. 2 is a plan view of a blank adapted to be folded into a carton embodying the present invention.
Figure 5:
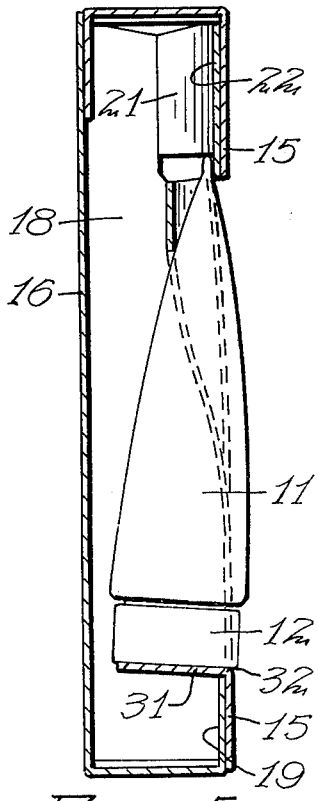
FIG. 5 is a side elevation view of the package shown in FIG. 1 taken along section lines 5—5 in FIG. 1.

As seen in FIG. 1 a novel display package 10 is illustrated suitable for displaying a dispensing tube 11 having a cap 12 attached to one end thereof. The opposite end of the tube 11 is flattened and crimped into a conventioanl closure. The carton in FIG. 1 is erected from the blank of FIG. 2 and illustrates that the blank includes a front panel 15, a back panel 16 and side panels 17. Conventional flaps making up an end closure are used on each end of the carton and the particular embodiment shown. An additional side flap 18 is shown having attached to the top end thereof a restraining flap 20 made up of a first restraining portion 21 extending horizontally and hingedly connected to the additional side flap 18 and a second restraining portion 22 hingedly connected to the first restraining portion 21, and having an additional vertical length for engaging the crimped end of the tube 11. The front panel 15 has formed therein an opening 30 whose size and shape is dependent on the particular dispensing tube to be contained therein, but it is generally extensive toward the top and bottom of the front panel 15. At the lower end of the opening 30 is a support flap 31 which is hingedly attached along hinge line 32 and is adpated to be folded inwardly to provide support for the dispensing tube 11 by contacting the cap 12.

The dimensions of the bottom closure flaps may be varied to provide additional support for the tube. The vertically extending tucked in flap 19 may be arranged to directly underlie the inwardly folded flap 31 to prevent ripping or distortion. The particular embodiment shown illustrates a cut out area 19A shown in FIG. 2 to provide a recess to surround the flap 31 along the line 32.

Figure 3:
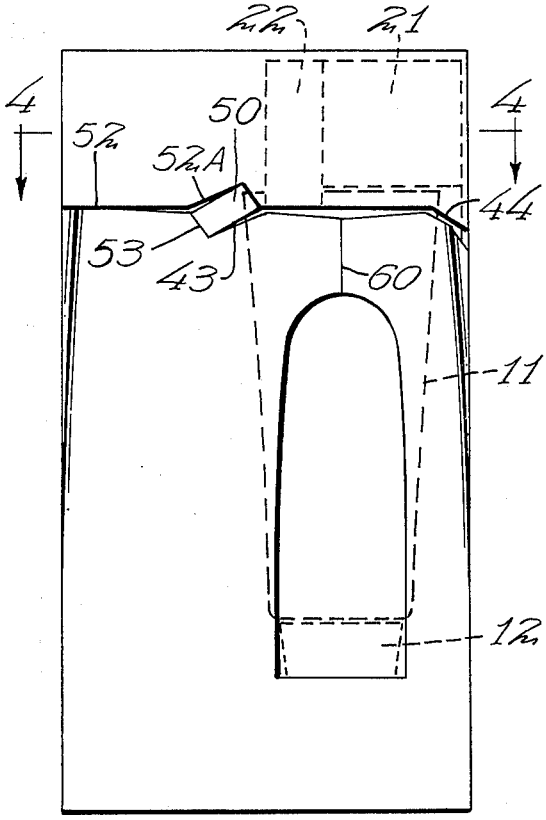
FIG. 3 is a front elevation view of the carton folded into a blank in FIG. 2, with the position of the dispensing tube shown in dash lines.
Figure 4:
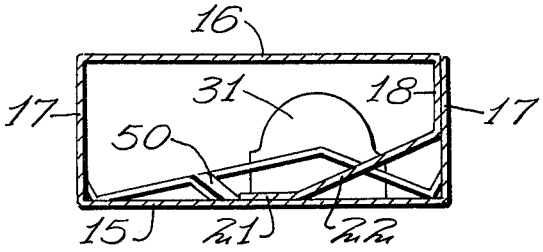
FIG. 4 is a top plan view in section on the carton in FIG. 3 taken along section lines 4—4 in FIG. 3.

A horizontal line cut 40 establishes tube base restraining sections 41 including two vertically disposed areas in the front panel 15 and having downwardly angled sections 43 and 44 on either side of the line cut 40 which permit the two base restraining sections 41 to be flexed inwardly below said line cut to form a recessed slot which can receive the crimped base of the tube 11 and hold it in place against that restraining section 41 located immediately above the line cut 40. In addition, it may be desirable with certain proportioning of the tube and the carton to include a downwardly angled connecting section 50 on at least one side of the line cut 40 which allows a second line cut to be made 52 extending across the remainder of the front panel 15 which reduces the amount of inward flex on that portion of the front panel 15 not directly adjacent to the tube 11 when in position on the support flap 31. The connecting section 50 is defined by a line cut extension 52A at an angle parallel to the downwardly angled line cut 43 and by hinge lines 53 normal thereto defining a substantially rectangular connecting section 50. A hinge line made by scoring or the like 60 is formed immediately above the opening 30 to help that portion of the base restraining section 41 directly below the line cut 40 to flex inwardly without distorting the surface of the paperboard. As viewable in FIG. 3 and FIG. 4 the line cut allows the two sections to be moved relative to one another forming a recess adaptable for receiving the wide or crimped end of the tube 11, and the package may be designed so that the crimped end of the tube extends upwardly to the end of the carton. For those configurations where that is not desirable, it is often desirable to include the restraining flap 21 along with the extension 22 which are folded out and cross the plane of the crimped end of the tube 11 as shown in FIG. 4 hooking it in and preventing it from moving.

In accordance with the Patent Statutes, I have described the principles of construction and operation of my improvement in DISPLAY CARTON FOR TUBES; and while I have endeavored to set forth the best embodiment thereof, I desire to have it understood that obvious changes may be made within the scope of the following claims without departing from the spirit of my invention.

I claim:

1. A carton made from foldable paperboard or similar sheet-like material and suitable for storage, shipment and display of deformable dispensing tubes or the like, said carton comprising:

opposed, parallel front and back panels;

first and second side panels in opposed relation connecting said front and back panels in a rectangular tube-like configuration;

means for supporting the cap of said tube, said means adapted to bear the weight of said tube and locate said tube near said front panel;

an elongated die cut opening in said front panel located above said means for supporting said tube and adapted to serve as a clearance recess for at least a portion of said tube;

a tube base restraining section formed in a first portion of said front panel including a first line cut formed horizontally across said first portion of said front panel and spaced above said means for supporting said tube and said tube opening, said first line cut having downwardly angled portions on either side thereof to permit that portion of said front panel located below said first line cut to be flexed inwardly and thereby create a recessed slot adapted to receive the crimped base of said tube and hold it in place against the portion of said front panel located above said first line cut; and a downwardly angled connecting section at one side of said first line cut connecting said first line cut to a second line cut extending horizontally across the remainder of said front panel, said downwardly connection section permitting that section of said front panel below said line cut to flex inwardly to receive said tube yet allowing the remainder of said front panel above said line cut to stay in normal flat position.

2. The carton of claim 1 and including a restraining flap hingedly attached to the interior of said tube-like configuration and adapted to extend horizontally over the crimped base of said tube and thereby prevent said tube, when in position, from moving out of vertical position against said means for supporting said tube.

3. The carton of claim 2 wherein said restraining flap includes a bottom edge adapted to cross said crimped end of said tube and including a second restraining portion having an additional vertical length adapted to engage said crimped end of said tube in a vertical direction to further restrict movement of said tube when in position.

* * * * *